United States Patent [19]

Picaud

[11] Patent Number: 4,556,080

[45] Date of Patent: Dec. 3, 1985

[54] CASING WITH ASSISTED OPENING FOR PROTECTING AN APPARATUS IN THE FORM OF A POST

[75] Inventor: Michel M. R. Picaud, Saint Dizier, France

[73] Assignee: Societe Anonyme dite: Societe Metallurgique Haut-Marnaise, Joinville, France

[21] Appl. No.: 626,213

[22] Filed: Jun. 29, 1984

[30] Foreign Application Priority Data

Jun. 29, 1983 [FR] France ..... 83 10780

[51] Int. Cl.[4] ..... E03B 9/06

[52] U.S. Cl. ..... 137/296; 137/371; 137/377; 137/800; 220/211; 220/363

[58] Field of Search ..... 137/296, 371, 377, 382.5, 137/800; 220/362, 363, 364, 211

[56] References Cited

U.S. PATENT DOCUMENTS

| | | | |
|---|---|---|---|
| 926,027 | 6/1909 | Smith | 137/296 |
| 1,086,841 | 2/1914 | Mueller | 137/296 |
| 2,585,694 | 2/1952 | Sisson | 137/296 |
| 2,869,576 | 1/1959 | Kennedy | 137/296 |
| 2,923,430 | 2/1960 | Stengele | 220/264 |

FOREIGN PATENT DOCUMENTS

| | | | |
|---|---|---|---|
| 2829727 | 6/1978 | Fed. Rep. of Germany . | |
| 811384 | 12/1935 | France . | |
| 1066861 | 6/1978 | France . | |
| 2427240 | 12/1979 | France . | |
| 210294 | 1/1967 | Sweden | 220/211 |

*Primary Examiner*—George L. Walton

*Attorney, Agent, or Firm*—Scully, Scott, Murphy & Presser

[57] ABSTRACT

The casing of the invention comprises a fixed part 1 fixedly mounted to the post 10 below the zone to be protected, this fixed part comprising, on one side of post 10, a support structure 14; a mobile part 15 for covering, in the closed position, the upper part of the post; a mechanical connection mounted between the support structure 14 and the mobile part 15; and an assistance device 22 adapted to exert a force tending to drive the mobile part during its upward movement.

11 Claims, 4 Drawing Figures

15
16
b
27
26
28
b
13
20
25
14
20'
18
22
23
18'
21
10
3
21'
1
8
2
9

CASING WITH ASSISTED OPENING FOR PROTECTING AN APPARATUS IN THE FORM OF A POST

BACKGROUND OF THE INVENTION

The present invention relates to an opening casing for protecting an apparatus in the form of a post whose head comprises parts to be protected not only from bad weather, shocks or use by unauthorized persons but also against acts of vandalism.

The invention applies more particularly, but not exclusively, to the protection of fire hydrants which, as is known, consist of standardized water connections placed above the ground on a support having the general shape of a post.

In this case, the parts to be protected are essentially the connecting elements intended to receive the fire hoses and the operating element for opening and closing, with drainage, of the means for closing the fire hydrant.

It is clear that in this case it is advisable to provide a protection device which may be rapidly freed when the hydrant is brought into service and which, once removed, cannot form a hindrance to the sequence of operations. This device must then be readily replacable after use of the hydrant.

SUMMARY OF THE INVENTION

The aim of the invention is then to attain all these results. For this, it provides a casing comprising:

a fixed part fixedly mounted on the hydrant below the zone to be protected, this fixed part comprising, on one side of the hydrant, a support structure, a mobile cover-forming part, intended to cover the upper part of the hydrant in the closed position while providing preferably a continuity of form and/or sealing with the fixed part, a mechanical connection mounted between the support structure and the mobile part, this connection allowing an upward movement of the mobile part with respect to the fixed part so as to obtain opening of the casing and a downward movement for return thereof to the closed position, and an assistance device mounted between the fixed part and the mobile part, this assistance device being designed so as to exert a force tending to drive the mobile part during its upward movement.

Preferably, in such a structure, said connection is designed so that the mobile part of the casing does not occupy more room on the ground in the open position than in the closed position.

According to another characteristic of the invention, said assistance device comprises means for accumulating, in the form of potential energy, a part of the force exerted for closing the casing and then releasing this potential energy at the time of opening. Such an assistance device may then consist of at least one pneumatic spring, a metal spring, a resilient rubber element etc...

This assistance device may further comprise a drive element such as an electric motor, a thermal motor or even a hydraulic system.

According to another advantageous characteristic of the invention, in the case of a fire hydrant, the assistance device may use the pressure of the water supplying the fire hydrant, either by means of a hydraulic piston and cylinder device subjected directly to the pressure of the water, or by means of a hydraulic circuit using the pressure of the water for moving a hydraulic fluid.

Of course, the casing may further comprise a mechanism for locking the mobile part of the fixed part, for example by means of a key.

BRIEF DESCRIPTION OF THE DRAWING

One embodiment of the invention will be described hereafter by way of non limiting example, with reference to the accompanying drawings in which.

DETAILED DESCRIPTION OF THE PREFERRED EMBODIMENTS

Figure 1:
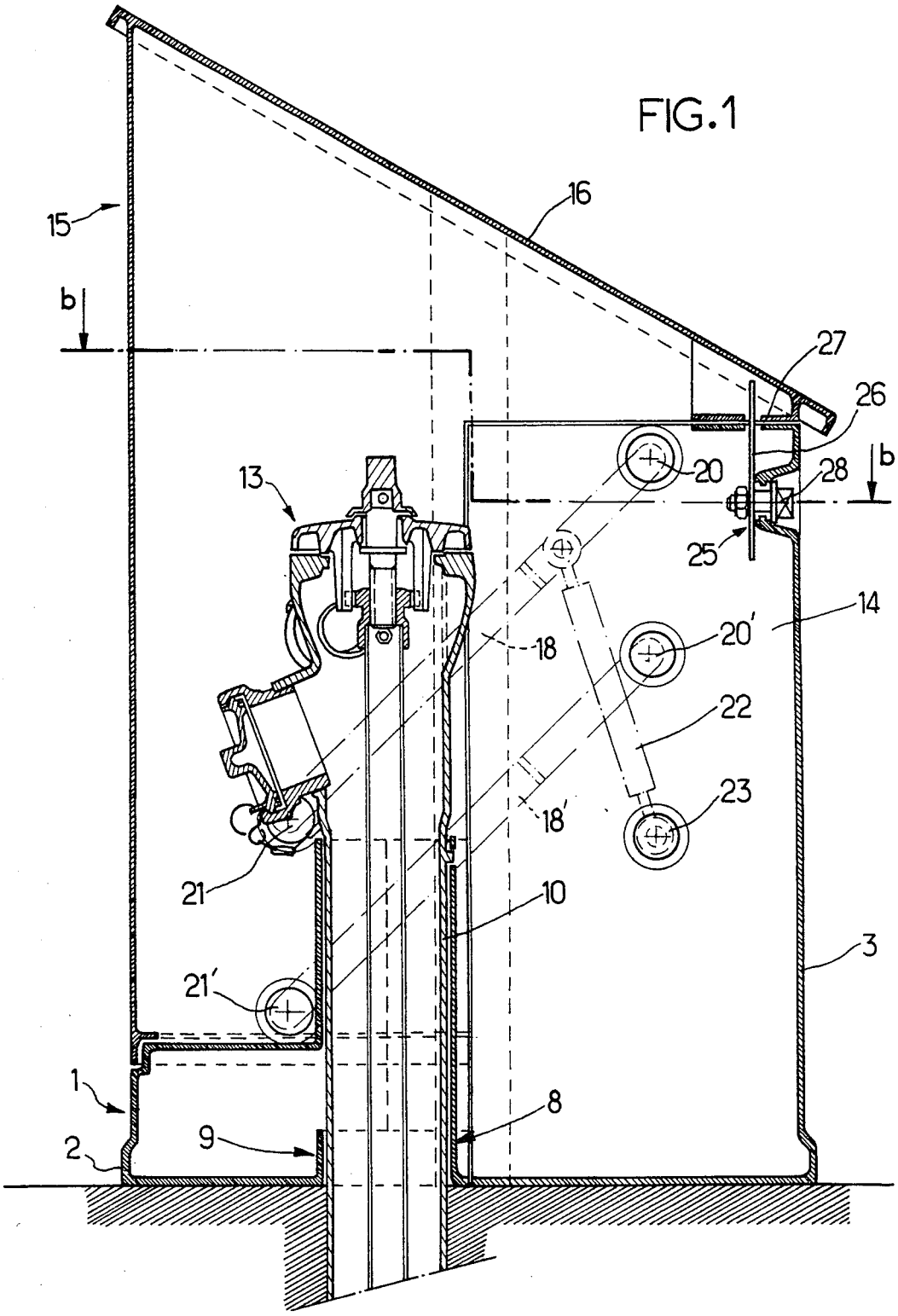
FIG. 1 is an axial vertical section of a fire hydrant equipped with a casing in accordance with the invention.
Figure 2:
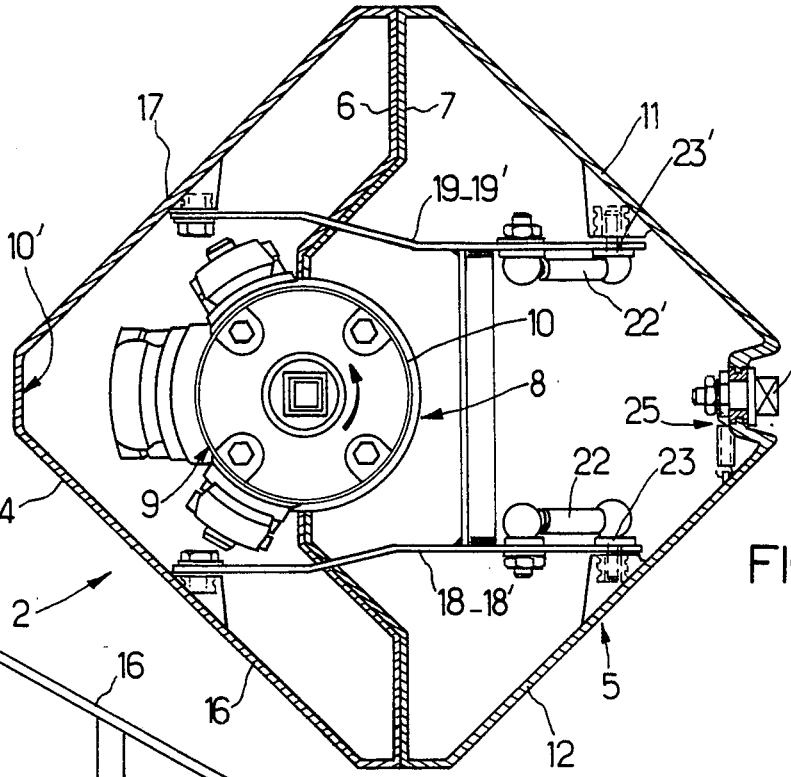
FIG. 2 is a cross section through B—B of FIG. 1.

With reference to FIGS. 1 and 2, the casing comprises first of all a fixed part 1 comprising a base 2 and a support structure 3.

Base 2 has a tubular shape with a diamond-shaped section and is formed by assembling together two elements with triangular section 4,5 (FIG. 2). The faces 6,7 of these two elements 4,5 by which this assembly is formed have in their central part a semi-cylindrical shape, 8,9 offset slightly towards the outer corner 10' of element 4 and in which the lower part of hydrant 10 passes. These two semi-cylindrical shapes 8,9 grip round hydrant 10 in the fashion of a collar and thus ensure fixing of base 2 to hydrant 10.

The two outer face 11,12 of element 5 of base 2 are extended upwardly to a level situated slightly above the head 13 of the fire hydrant 10 and form said support element 14.

The mobile part 15 has a partly tubular shape with diamond cross-section extending outside the outer faces 11,12,16 and 17 of base 2 and ending in an oblique roof 16.

Of course, the lower contour of this mobile part 15 is cut out so as to match the contour of the upper edge of the fixed part 1.

The connection of the fixed part to the mobile part is provided by means of two pairs of links 18,18'-19,19' forming two hinged parallelograms situated on each side of hydrant 10.

Each of these pairs of links 18,18' and 19,19' is pivotably mounted, on one side, on two respective parallel pins 20,20' mounted in the upper part of the support element 14 and, on the other side, on two respective parallel pins 21,21' mounted in the lower part of the mobile part 15.

Figure 3:
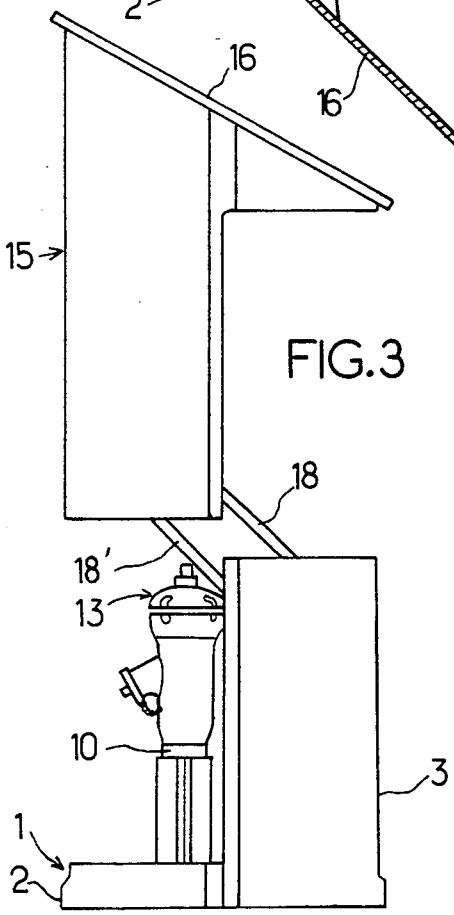
FIGS. 3 and 4 are two schematical sectional views showing the casing in the open position and in the closed position.
Figure 4:
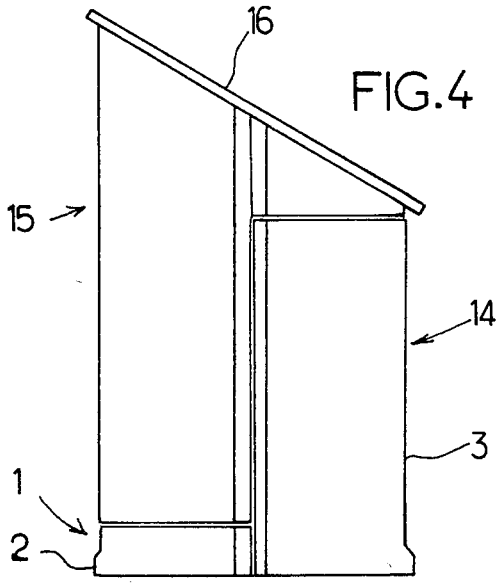

In the example shown, the straight line connecting together the centers of the two pins 20,20' and the straight line connecting together the centers of the two pins 21,21' are vertical, so that during opening and closing, FIGS. 3 and 4, the mobile part 15 will remain vertically centered.

As mentioned above, the casing further comprises an assistance device which, in this case, consists of two pneumatic springs 22,22' mounted for pivoting, on one side, respectively on links 18,19 and, on the other side, on the faces 11,12 of the support element 14 (pin 23,23') in the alignment of pins 20 and 20'.

Thus, these pneumatic springs 22,22' accumulate a part of the force exerted for closing the casing and then restore it for automatic opening.

The support element 14 further comprises a locking mechanism 25 of conventional type comprising a pivotable latch 26 cooperating with a keeper 27 provided in the mobile part 15. In the example shown, latch 26 may be driven by means of an actuating square 28.

Of course, the invention is not limited to the diamond shaped section of the casing previously described. This could very well have a circular or oval form or even a more complex form.

It will finally be noted that the mobile part 15 of the previously described casing may advantageously serve for supporting different advertizing patterns.

I claim:

1. An opening casing for protecting an apparatus in the form of a post (10) whose head comprises parts to be protected, characterized in that the casing comprises:

a fixed part (1) fixedly mounted to the post (10) below the zone to be protected, this fixed part comprising, on one side of the post (10), a support structure (14);

a mobile cover-forming part (15), for covering in the closed position the upper part of the post (10) while ensuring preferably a continuity of shape and/or of sealing with the fixed part (10);

a mechanical connection between the support structure (14) and the mobile part (15), including a first pair of vertically aligned upper and lower pins (20,20') connected to the fixed part and spaced apart a pre-set distance, a second pair of vertically aligned upper and lower pins (21,21') connected to the cover-forming part and spaced apart said pre-set distance, an upper connecting link (18) connected to the upper pins (21,21) of the first and second pairs of pins, and a lower connecting link (18) connected to the lower pins of the first and second pairs of pins; and an assistance device mounted between the fixed part and the mobile part to help move the mobile part upward;

whereby the upper and lower links (18,18') connect the cover-forming part to the fixed part for upward and downward movement between open and closed positions and wherein the casing does not extend over more ground area than when the mobile part is in the open position than when the mobile part is in the closed position.

2. The casing according to claim 1, characterized in that said assistance device (22) comprises means for accumulating in the form of potential energy a part of the force exerted for closing the casing and then releasing this potential energy at the time of opening.

3. The casing according to claim 2, characterized in that the assistance device (22) consists of at least a pneumatic spring, a metal spring or even a resilient element made from rubber or similar material.

4. The casing according to claim 1, characterized in that the assistance device (22) comprises a drive element such as an electric motor, a thermal motor or even a hydraulic system.

5. The casing according to claim 1, characterized in that, in the case where the casing provides protection for a fire hydrant, the assistance device (22) uses the pressure of the water supplying the post (10).

6. The casing according to claim 5, characterized in that the assistance device comprises a piston and cylinder arrangement subjected directly to the pressure of the water.

7. The casing according to claim 5, characterized in that the assistance device (22) comprises a hydraulic circuit using the pressure of the water for moving the hydraulic fluid.

8. The casing according to any one of claim 2, or claim 3, or claim 4, or claim 5, or claim 6, or claim 7, characterized in that it comprises a mechanism (25) for locking the mobile part (15) to the fixed part (1) for example by means of a key or actuating square.

9. The casing according to claim 1 wherein:

the fixed part includes a base, and the support structure extends upward from a back portion thereof;

the cover-forming part includes a top and a front wall extending downward from a front portion thereof;

when the cover-forming part is in the closed position, the front wall of the cover is located adjacent and forward of the support structure of the fixed part; and the connecting links slant upwardly rearwardly whereby, as the cover moves from the closed position to the open position, the connecting links move the cover forward, away from the support structure, and upward to prevent the support structure from interferring with movement of the cover from the closed position to the open position.

10. The casing according to claim 9 wherein:

the first pair of pins are connected to the support structure of the fixed part;

the second pair of pins are connected to the front portion of the cover; and when the cover is in the closed position, the lower pin of the first pair of pins is located at a level above the level of the upper pin of the second pair of pins.

11. The casing according to claim 10 wherein the assistance device includes:

an expandable cylinder extending between the support structure and a selected connecting link;

a pin vertically aligned with the first pair of pins and pivotally connecting a bottom end of the expandable cylinder to the support structure; and means connecting a top end of the expandable cylinder to the selected connected link.

* * * * *